US009076389B2

(12) United States Patent
Haraguchi et al.

(10) Patent No.: US 9,076,389 B2
(45) Date of Patent: Jul. 7, 2015

(54) PROJECTION-TYPE IMAGE DISPLAY DEVICE, IMAGE PROJECTION CONTROL DEVICE, AND IMAGE PROJECTION CONTROL METHOD

(71) Applicant: Panasonic Intellectual Property Management Co., Ltd., Osaka-shi (JP)

(72) Inventors: Masahiro Haraguchi, Osaka (JP); Masutaka Inoue, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/231,755

(22) Filed: Apr. 1, 2014

(65) Prior Publication Data

US 2014/0292836 A1 Oct. 2, 2014

(30) Foreign Application Priority Data

Apr. 1, 2013 (JP) ..... 2013-075616
Mar. 24, 2014 (JP) ..... 2014-059860

(51) Int. Cl.
*G09G 3/34* (2006.01)
*G09G 3/00* (2006.01)

(52) U.S. Cl.
CPC ..... *G09G 3/3406* (2013.01); *G09G 3/002* (2013.01); *G09G 2310/0235* (2013.01); *G09G 2320/043* (2013.01)

(58) Field of Classification Search
CPC . G09G 3/3406; G09G 3/3648; G09G 3/3611; G09G 2320/0276; G09G 2360/16; G09G 2320/0626
See application file for complete search history.

(56) References Cited

U.S. PATENT DOCUMENTS

| | | | | |
|---|---|---|---|---|
| 5,917,558 | A | 6/1999 | Stanton | |
| 6,400,511 | B2 | 6/2002 | Vanlier et al. | |
| 2001/0022692 | A1 | 9/2001 | Vanlier et al. | |
| 2006/0279709 | A1 * | 12/2006 | Yamamoto | 353/85 |
| 2011/0210680 | A1 * | 9/2011 | Yamamoto et al. | 315/209 R |

FOREIGN PATENT DOCUMENTS

| | | | |
|---|---|---|---|
| EP | 0676115 | B1 | 6/2000 |
| JP | H08-505031 | A | 5/1996 |
| JP | 2003-102030 | A | 4/2003 |
| JP | 2003-518643 | A | 6/2003 |
| JP | 2004-212890 | A | 7/2004 |
| JP | 2004-309622 | A | 11/2004 |
| JP | 2007-171258 | A | 7/2007 |
| JP | 2008-130522 | A | 6/2008 |
| WO | 95/11572 | A1 | 4/1995 |
| WO | 01/49041 | A1 | 7/2001 |

* cited by examiner

*Primary Examiner* — Kevin Nguyen
(74) *Attorney, Agent, or Firm* — Shinjyu Global IP

(57) ABSTRACT

The projection-type image display device includes a light source unit, a color generation unit provided on the optical path of emitted light from the light source unit and configured to generate multiple colors of light from emitted light from the light source in a time-division manner by rotating at a predetermined rotation cycle, a light modulation unit, and a control unit. In accordance with a color component of the input image signal, the control unit sets current values for current to be applied to the light source unit and a polarity inversion timing for inverting the polarity of the light source unit. The control unit applies current having the current values to the light source unit while inverting the polarity according to the polarity inversion timing. The control unit shifts the polarity inversion timing according to change in the current values for current to be applied to the light source unit.

15 Claims, 11 Drawing Sheets

Embodiment 1

Embodiment 2

PROJECTION-TYPE IMAGE DISPLAY DEVICE, IMAGE PROJECTION CONTROL DEVICE, AND IMAGE PROJECTION CONTROL METHOD

PRIORITY

This application claims priority to Japanese Patent Application No. 2013-075616 filed on Apr. 1, 2013 and Japanese Patent Application No. 2014-059860 filed on Mar. 24, 2014. The entire disclosure of Japanese Patent Application 2013-075616 and Japanese Patent Application No. 2014-059860 is hereby incorporated herein by reference.

BACKGROUND

1. Technical Field

The present disclosure relates to a projection-type image display device, an image projection control device, and an image projection control method for performing time-division color display.

2. Background Art

Patent Document 1 (JP 2003-518643A) discloses a projection-type image display device. This projection-type image display device includes a color wheel that has multiple segments, and a projection optical system that has a light source (lamp light source). With this projection-type image display device, constant power is supplied to the light source while changing the polarity of a square wave current at a constant interval, and a current pulse is supplied before every change in the polarity. This increases the current intensity of the light source, thereby improving the stability of the arc discharge in the light source and increasing the lifetime of the light source.

SUMMARY

However, with the projection-type image display device disclosed in Patent Document 1, the timing of the current pulse is controlled such that the current pulse is applied in accordance with the same timing for each color in the color wheel, and such that the number of applications is substantially the same among the colors. However, in the case of supplying a current pulse at a constant interval as disclosed in Patent Document 1, in the period of a specific color for which the current value decreases, the current value does not reach the current value required to increase the lifetime of the light source (referred to hereinafter as the "predetermined current value"). As a result, polarity inversion occurs with a low current value, thus lowering the stability of the arc discharge in the light source and lowering the image display quality.

The present disclosure provides a projection-type image display device, an image projection control device, and an image projection control method that are effective in increasing the lifetime of the light source while also improving the quality of displayed images.

A projection-type image display device according to a first aspect of the present disclosure is a projection-type image display device that receives an image signal and displays an image based on the input image signal by projection, including: a light source unit configured to emit light based on an applied current; a color generation unit that is provided on an optical path of emitted light from the light source unit, the color generation unit being configured to generate a plurality of colors of light from the emitted light in a time-division manner by rotating at a predetermined rotation cycle; a light modulation unit configured to modulate the plurality of colors of light generated by the color generation unit, based on the input image signal; and a control unit configured to control the light source unit and the light modulation unit. In accordance with a color component of the input image signal, the control unit sets current values for current to be applied to the light source unit and a polarity inversion timing for inverting a polarity of the light source unit, and, in synchronization with the predetermined rotation cycle of the color generation unit, the control unit applies current having the current values to the light source unit while inverting the polarity of the light source unit according to the polarity inversion timing. The control unit furthermore shifts the polarity inversion timing according to change in the current values for current to be applied to the light source unit.

An image projection control method according to a second aspect of the present disclosure is for controlling a projection-type image display device that is provided with a light source unit and a color wheel and that receives an image signal and displays an image based on the input image signal by projection. The image projection control method is a method of: setting current values for current to be applied to the light source unit and a polarity inversion timing for inverting a polarity of the light source unit, in accordance with a color component of the input image signal; applying current having the current values to the light source unit while inverting the polarity of the light source unit according to the polarity inversion timing, in synchronization with a predetermined rotation cycle of the color wheel; and shifting the polarity inversion timing according to change in the current values for current to be applied to the light source unit.

A projection-type image display device, an image projection control device, and an image projection control method according to the present disclosure are effective in increasing the lifetime of the light source while also improving the image quality.

DETAILED DESCRIPTION

Hereinafter, embodiments of the present invention will be described in detail with reference to the drawings as appropriate. Note that there are cases where descriptions in greater detail than necessary will not be given. For example, there are cases where detailed descriptions will not be given for well-known matter, and where redundant descriptions will not be given for configurations that are substantially the same. The purpose of this is to avoid unnecessary redundancy in the following description and to facilitate understanding by a person skilled in the art. It will be apparent to those skilled in the art from this disclosure that the following descriptions of the embodiments are provided for illustration only and not for the purpose of limiting the invention as defined by the appended claims and their equivalents.

It should be noted that the drawings are schematic, and the proportions of dimensions and the like differ from a real situation. Specific dimensions and the like should therefore be determined with consideration given to the following description. Also, included portions of course have different dimensional relationships and proportions among the drawings.

Embodiment 1

Embodiment 1 will be described below with reference to FIGS. 1 to 8.

1-1. Overview

Figure 1:
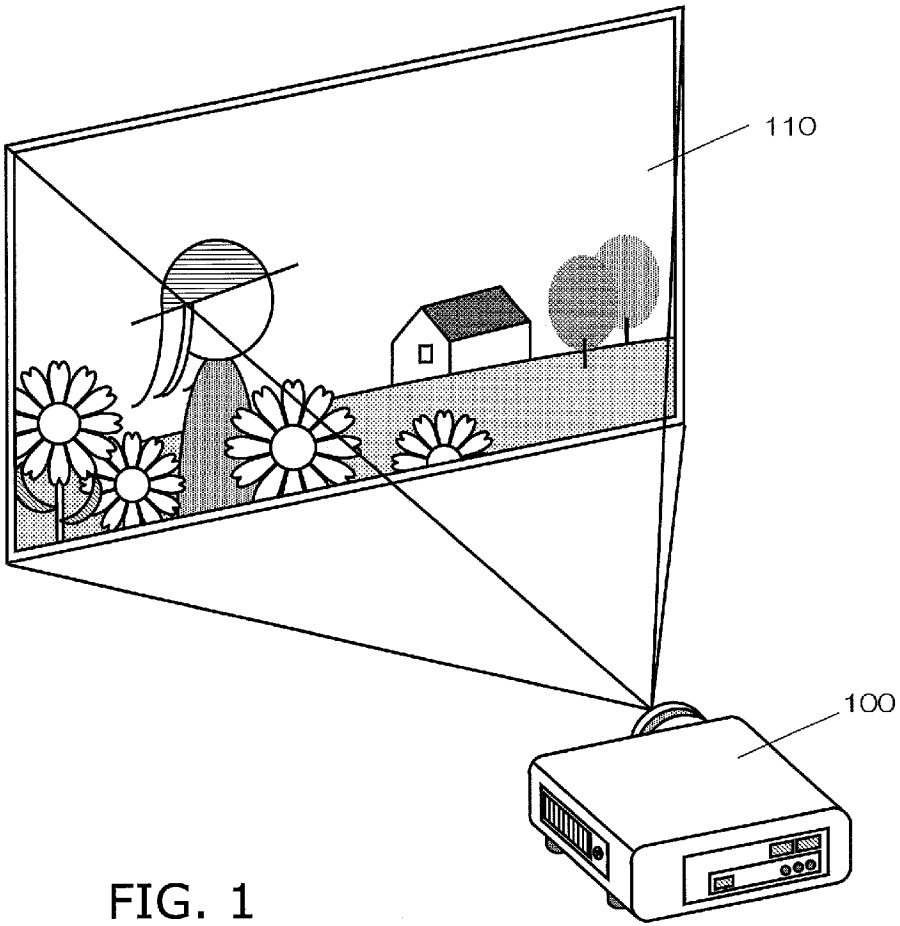
FIG. 1 is a diagram showing a usage state of a projection-type image display device.

FIG. 1 shows a usage state of a projector 100 (example of a projection-type image display device) according to Embodiment 1. The projector 100 generates an image by using a DMD to reflect light emitted by a light source unit, and projects the generated image onto a screen 110 via a projection optical system.

1-2. Configuration

1-2-1. Overall Configuration

Figure 2:
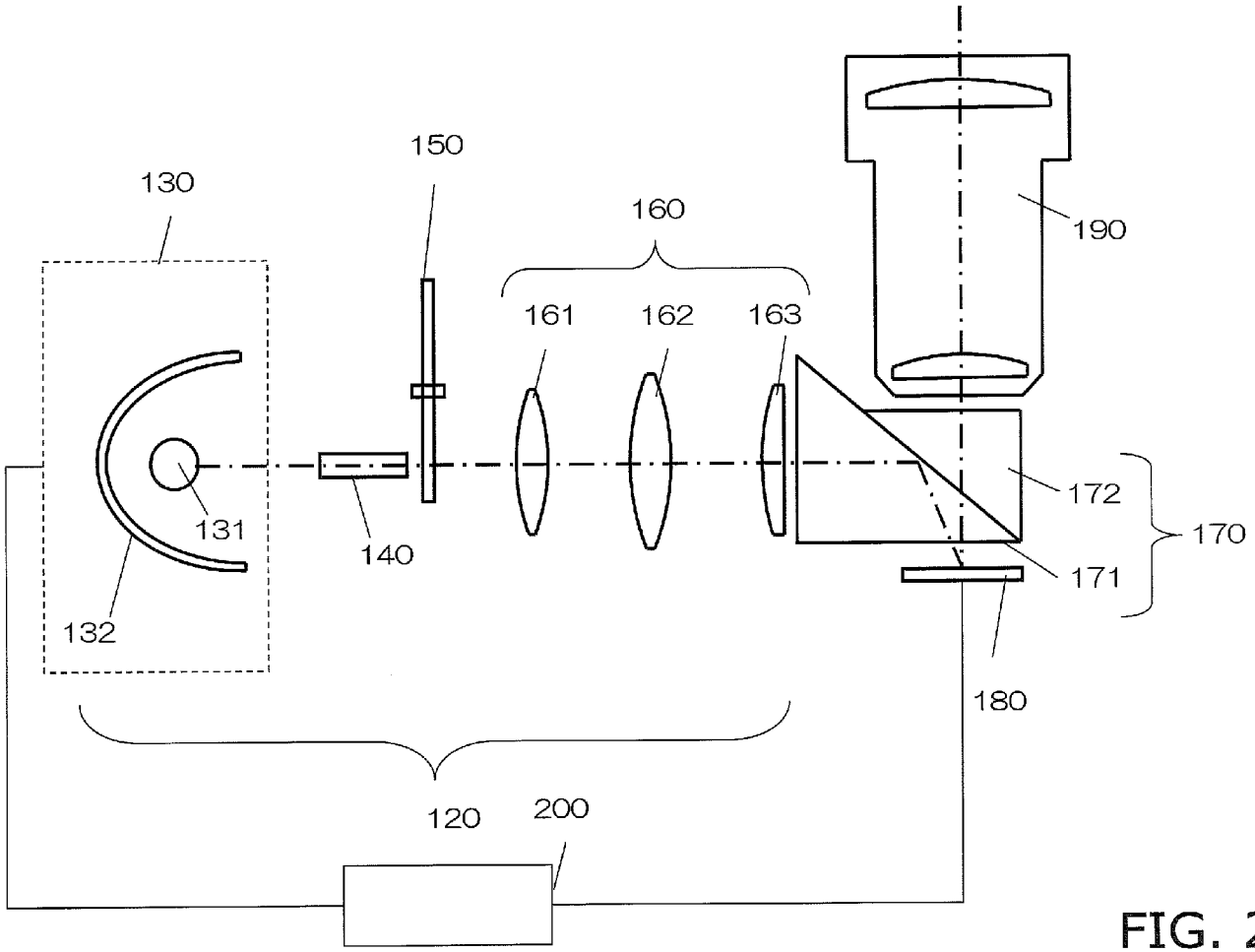
FIG. 2 is a diagram schematically showing an overall configuration of a projection-type image display device.

The overall configuration of the projector 100 will be described below with reference to FIGS. 1 and 2. FIG. 2 is a diagram schematically showing the overall configuration of the projector 100 according to Embodiment 1.

The following describes the detailed configuration of the projector 100.

The projector 100 includes a light source unit 130 (example of a light source unit), a rod integrator 140, a color wheel 150 (example of a color generation unit), a relay optical system 160, a total reflection prism 170, a digital mirror device 180 (referred to hereinafter as a "DMD") (example of a light modulation unit), a projection optical system 190, and a control unit 200 (example of an image projection control device or a control unit). The light source unit 130, the rod integrator 140, the color wheel 150, and the relay optical system 160 constitute an illumination optical system 120.

Light that exited from the light source unit 130 of the projector 100 passes through the color wheel 150, and thus multiple colors of illumination light are generated in a time-division manner. Thereafter, the illumination light is incident on the total reflection prism 170. The light that was incident on the total reflection prism 170 is then incident on the DMD 180, and an image is generated. The generated image is projected onto the screen 110 via the projection optical system 190.

The light source unit 130 is a lamp light source. The light source unit 130 includes an arc tube 131 and a reflector 132. The arc tube 131 emits luminous flux that includes red light, green light, and blue light having different wavelength bands. The arc tube 131 is constituted by an ultrahigh pressure mercury lamp or a metal halide lamp, for example. The reflector 132 reflects luminous flux that exited from the arc tube 131 and aligns the exit directions.

The rod integrator 140 equalizes the illuminance of incident light. Light that is incident on the rod integrator 140 repeatedly undergoes total reflection inside the rod integrator 140, and then exits with a uniform illuminance distribution at the exit face of the rod integrator 140. The rod integrator 140 is provided at a position where it receives light that exited from the light source unit 130.

The color wheel 150 is arranged on the optical path of exiting light from the light source unit 130, in the vicinity of the rod integrator 140. The color wheel 150 has multiple segments. The color wheel 150 generates multiple colors of illumination light in a time-division manner by being rotated at a predetermined rotation cycle by a drive mechanism (not shown). The color wheel 150 is disc-shaped and has a color filter (not shown) that is made up of red (R), green (G), blue (B), and white (W) segments obtained by divisions made at predetermined angles. The color wheel 150 is configured such that one rotation is made up of the four R, G, B, and W segments. The color wheel 150 is configured so as to undergo at least two or more complete rotations when displaying one frame of an input image. In the description given later with reference to FIG. 9, a sub frame corresponds to one complete rotation of the color wheel in the target frame. A different current value is set for the light source unit 130 in each sub frame based on an image analysis result.

The light that passed through the color wheel 150 is guided to the DMD 180 by the relay optical system 160. The relay optical system 160 is constituted by multiple lenses that can maintain the uniformity of the illuminance distribution of the light that exits the rod integrator 140.

The light that exited the relay optical system 160 is guided to the DMD 180 by the total reflection prism 170. The total reflection prism 170 is constituted by a prism 171 and a prism 172. An air layer (not shown) exists between the adjacent faces of the prism 171 and the prism 172. The air layer is a thin layer of air. Luminous flux that is incident on the air layer at an angle greater than or equal to the critical angle undergoes total reflection. The luminous flux that undergoes total reflection is incident on the DMD 180.

The DMD 180 tilts micromirrors according to an input image signal. Accordingly, the light incident on the DMD 180 is divided into light that is to be incident on the projection optical system 190 and light that is reflected outside the effective range of the projection optical system 190. Among the luminous flux reflected by the DMD 180, the luminous flux that is to be incident on the projection optical system 190 passes through the total reflection prism 170 before being incident on the projection optical system 190. The luminous flux that was incident on the total reflection prism 170 is incident on the air layer at an angle less than the critical angle. This luminous flux therefore passes through the air layer and is incident on the projection optical system 190.

The projection optical system 190 is an optical system for enlarging incident luminous flux. The projection optical system 190 is constituted by a lens that has a focusing function and an enlarging function.

The control unit 200 controls the light source unit 130 and the DMD 180. The control unit 200 includes a processor such as a CPU and memories, and various functions related to later-described image projection control are executed by the processor executing a predetermined program. The memories include a ROM for storing fixed data and programs to be executed by the processor, a RAM used as a work area and a storage area for data and parameters that are changed as necessary in program processing, and the like.

1-2-2. System Configuration

Functions of the projector according to Embodiment 1 will be described below with reference to the drawings, focusing mainly on functions executed by the control unit 200.

Figure 3:
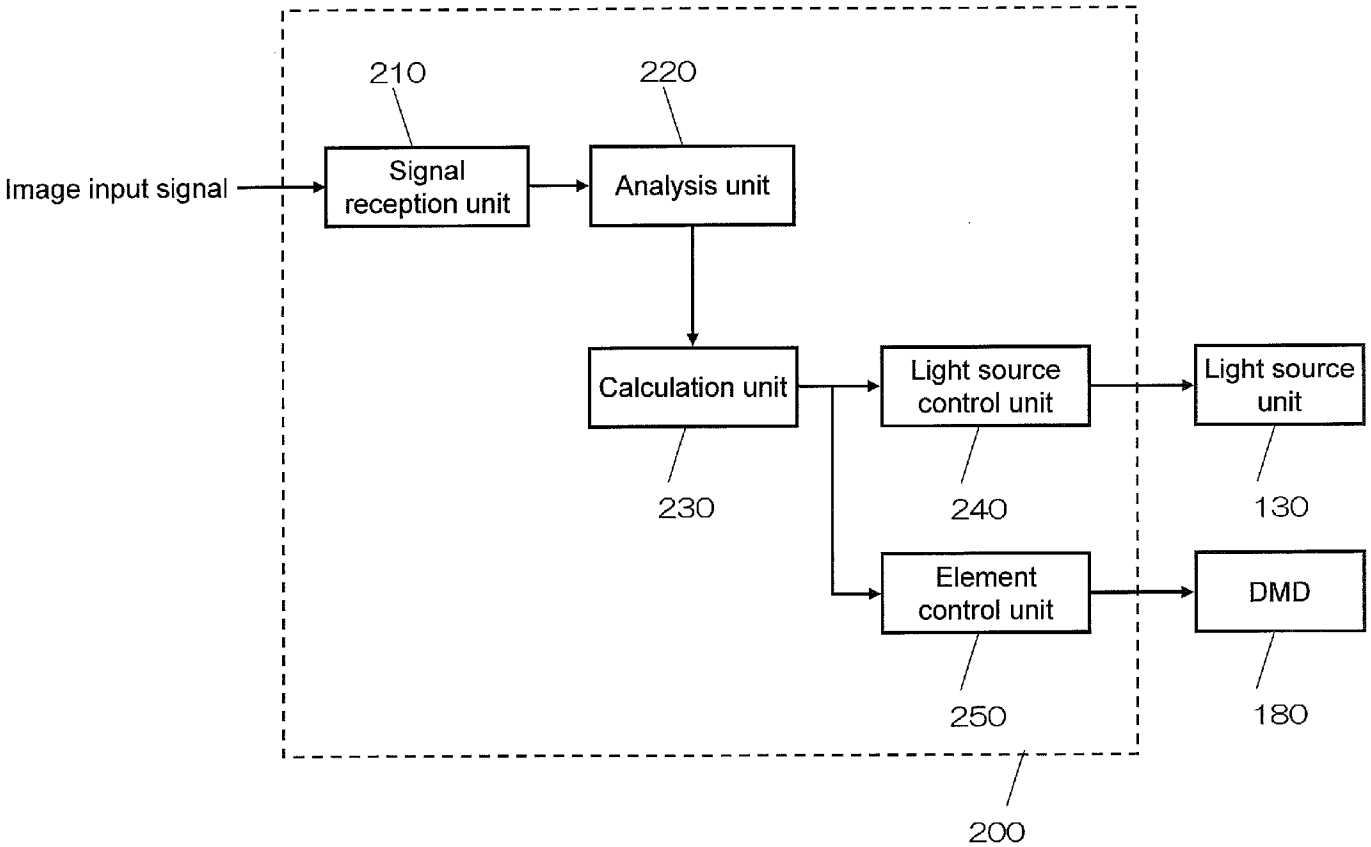
FIG. 3 is a block diagram showing functions of a control unit.

FIG. 3 is a block diagram showing functions of the control unit 200 according to Embodiment 1. As shown in FIG. 3, the control unit 200 has a signal reception unit 210, an analysis unit 220, a calculation unit 230, a light source control unit 240, and an element control unit 250.

The signal reception unit 210 receives an image signal input from an external device such as a DVD player or a TV tuner.

The analysis unit 220 analyzes the input image signal received by the signal reception unit 210. Specifically, the analysis unit 220 analyzes the saturation component of the input image signal corresponding to one frame. Note that the saturation component of the input image signal is obtained by HSV conversion or YUV conversion. Also, based on the input image signal for each of the pixels constituting the frame, the analysis unit 220 acquires the highest value for the saturation component of the input image signal as the input signal saturation.

The calculation unit 230 calculates a light quantity for each of the periods in which R, G, B, and W light exits from the light source unit 130, in synchronization with the corresponding R, G, B, and W periods of the color wheel. For example, the calculation unit 230 obtains predetermined light quantity ratios for the RGBW periods based on the input image signal, and changes the predetermined light quantity ratios based on the input signal saturations obtained by the analysis unit 220. Specifically, the calculation unit 230 calculates a current value for the current that is to be applied to the light source unit 130 according to the input signal saturation obtained as the analysis result of the analysis unit 220.

Figure 4:
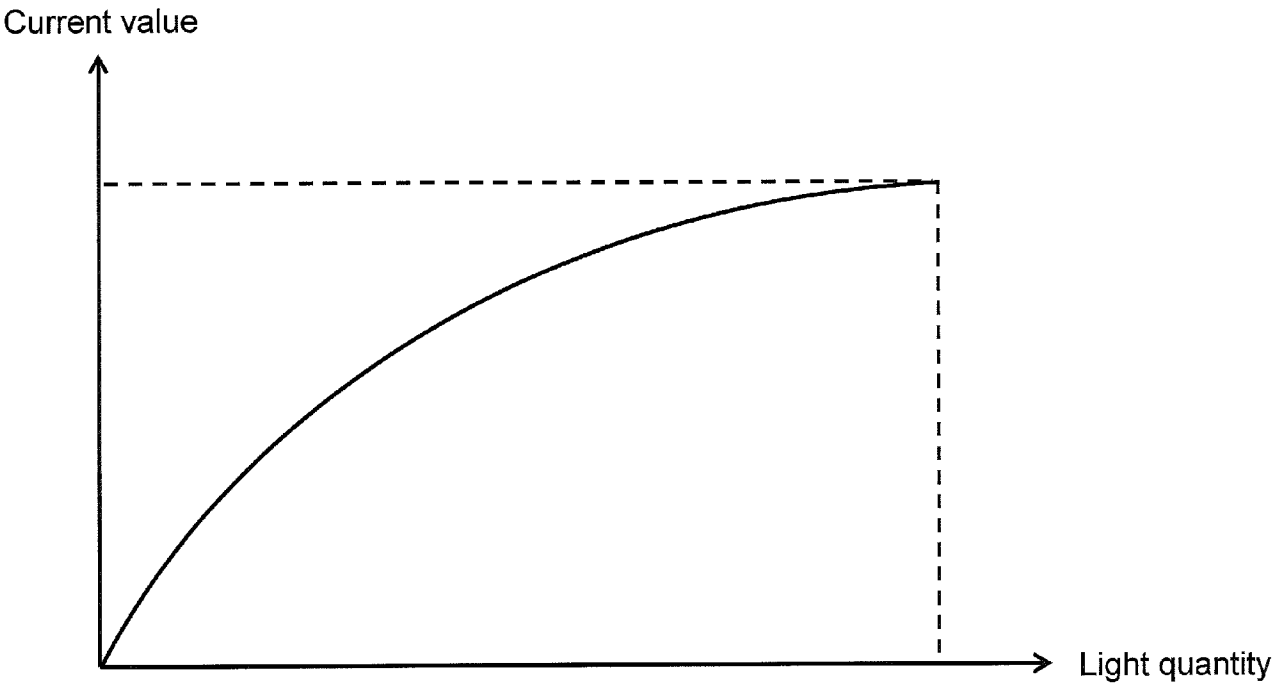
FIG. 4 is a diagram related to a light quantity/current value conversion function.

FIG. 4 is a graph showing a light quantity/current value conversion function according to Embodiment 1. The light quantity/current value conversion function shown in FIG. 4 is used in order to obtain the current value to be set for the light source based on the above-described light source light quantity ratio. The current value is shown as an absolute value here.

Note that the calculation unit 230 may calculate the light quantity ratio based on the correlation with the previous/subsequent frame. For example, if the input signal saturation has increased relative to the previous frame, the light quantities in the RGB periods are increased, and the light quantity in the W period is reduced. Here, the light quantity ratio may be made the same in the RGB periods in order to simplify the control. If the input signal saturation has decreased relative to the previous frame, the light quantities in the RGB periods are reduced, and the light quantity in the W period is increased.

For example, with the predetermined light quantity ratios corresponding to the RGBW periods, if brightness is to be prioritized, the calculation unit 230 can reduce the light quantities for the RGB periods and set a higher light quantity for the W period. Here, it is desirable that the integrated value of the light quantities for the RGBW periods is a value according to which the white balance is a predetermined value (e.g., a color temperature of 6500K or the like). On the other hand, if vividness is to be prioritized, the calculation unit 230 can increase the light quantities for the RGB periods and set a lower light quantity for the W period.

In a vivid image, vividness is intensified by increasing the light source light quantities in the RGBCMY (simple colors and complimentary colors) periods of the color wheel. In a bright image, the brightness can be intensified by increasing the light source light quantities in the CMYW (complimentary colors and white) periods.

The calculation unit 230 also performs light quantity setting such that a current value required to increase the lifetime of the light source unit 130 (predetermined current value) is reached in any of the RGBW periods, and sets the polarity inversion timing for inverting the polarity of the light source unit 130 in accordance with that period. For example, if the light source light quantity in any of the RGB periods is greater than that in the W period, light quantity setting is performed such that the predetermined current value is reached in at least the one of the RGB periods that has the highest current value. If the light source light quantity in the W period is the highest, light quantity setting is performed such that the predetermined current value is reached in the W period.

The light source control unit 240 applies an alternating current to the light source unit 130 based on the current values that correspond to the light quantity ratios for the RGBW periods, which are the output results of the calculation unit 230. The light source control unit 240 also performs control for inverting the polarity of the light source unit 130 at the set polarity inversion timing.

Figure 6:
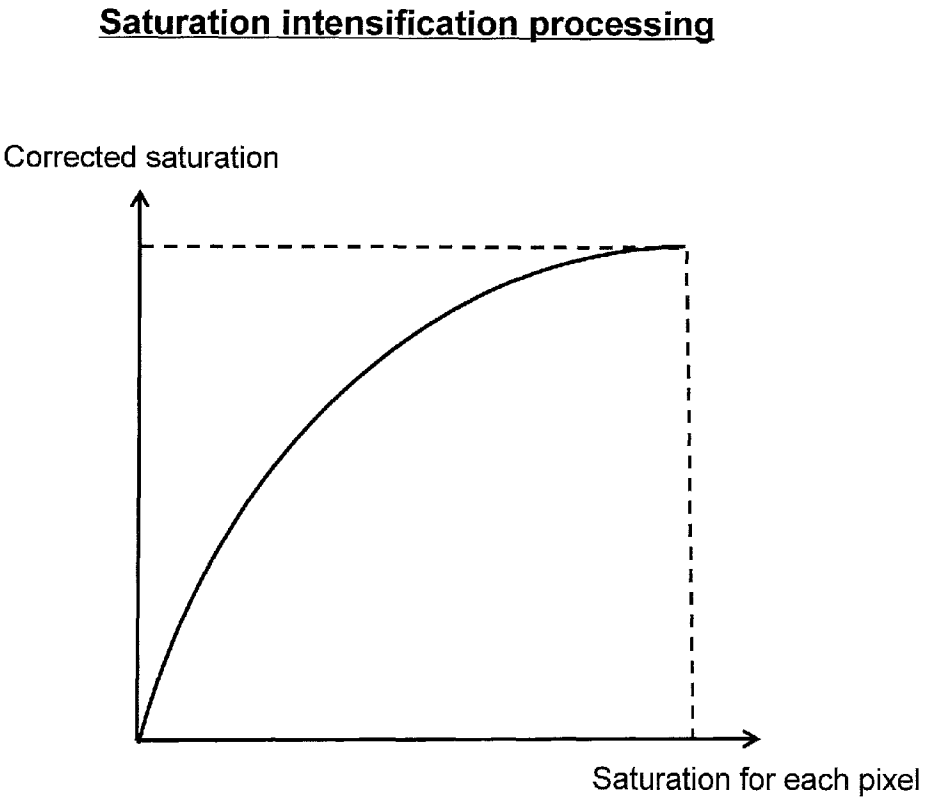
FIG. 6 is a diagram describing saturation intensification processing.
Figure 7:
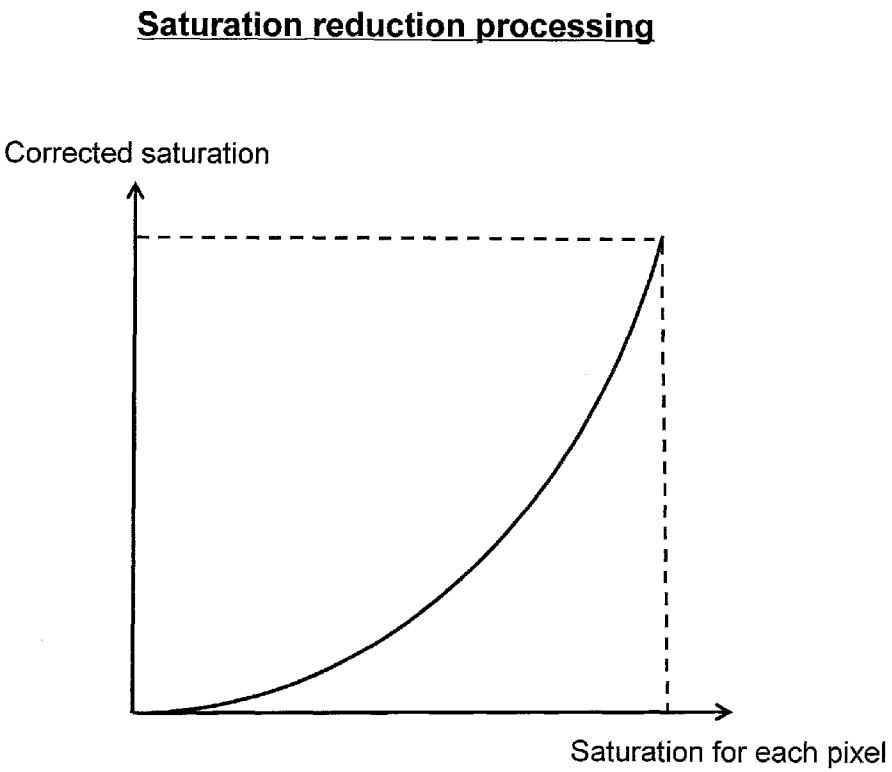
FIG. 7 is a diagram describing saturation reduction processing.

The light source control unit 240 also applies a current to the light source unit 130 in synchronization with the rotation cycle of the color wheel 150. Note that the polarity inversion timing corresponds to at least one cycle in the rotation cycle of the color wheel 150 or a fixed cycle input from the outside. Also, among the RGBW periods, the polarity inversion timing is either during or immediately after the period in which the light quantity is the highest light quantity, or during or immediately after the period in which the current value is greater than or equal to the predetermined current value. The polarity inversion timing is accordingly shifted. The element control unit 250 receives position information regarding the color wheel 150 and modulates the light source intensity so as to correspond to the color of the light to be emitted onto the DMD 180. The element control unit 250 also converts the input image signal into an image output signal according to the input signal saturation calculated by the calculation unit 230, and controls the DMD 180 based on the image output signal. This reduces color shift when there is a change in the light quantity ratios for W and RGB. Specifically, saturation intensification processing is performed if the input signal saturation is lower than a reference value, and saturation reduction processing is performed if the input signal saturation is higher than the reference value. FIG. 6 is a graph showing a saturation intensification processing function, and FIG. 7 is a graph showing a saturation reduction processing function. The element control unit 250 performs saturation intensification processing and saturation reduction processing on the pixels of the input image signal using the characteristics shown in FIGS. 6 and 7.

1-3. Operations

In the present embodiment, an alternating current whose amplitude has been modulated in synchronization with the color wheel 150 is applied to the light source unit 130. Here, the amplitude of the alternating current applied to the light source unit 130 is set such that the current value is greater than or equal to the predetermined current value in any of the RGBW periods. This enables stably lighting the light source, thus making it possible to increase the lifetime of the light source.

The input image signal received by the signal reception unit 210 is input to the analysis unit 220. The saturation component of the input image signal is analyzed in the analysis unit 220, and a value indicating the saturation of the input image signal is input to the calculation unit 230.

In the calculation unit 230, the light quantity ratios for the RGBW periods are determined based on the saturation of the input image signal obtained by the analysis unit 220, and current values corresponding to the light quantity ratios are calculated. At this time, the light quantity ratios are determined such that the calculated current value is greater than or equal to the predetermined current value in any of the RGBW periods.

In the light source control unit 240, a current having current values that correspond to the light quantity ratios for the RGBW periods that were calculated by the calculation unit 230 is applied to the light source unit 130. Also, the one of the RGBW periods in which the current value is greater than or equal to the predetermined current value is set as the polarity inversion timing, and the polarity of the applied current is inverted according to that polarity inversion timing.

Meanwhile, in the element control unit 250, the input image signal is converted into an image output signal according to the input signal saturation calculated by the calculation unit 230, and the DMD 180 is controlled based on the image output signal.

Figure 5:
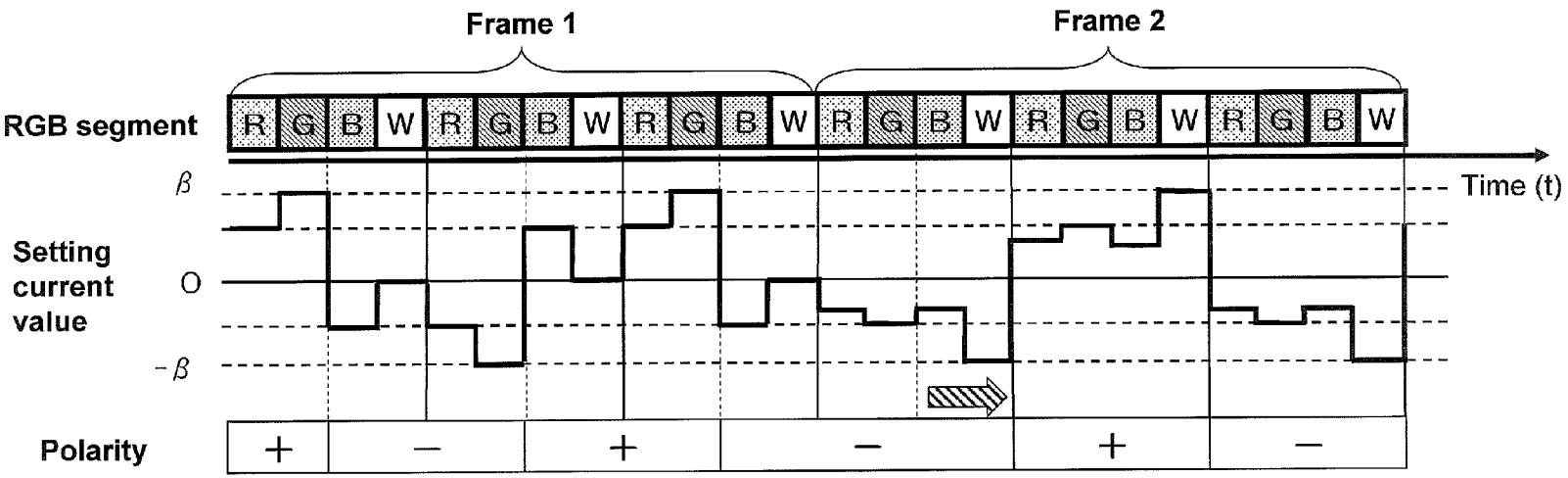
FIG. 5 is a diagram describing an example of processing.

FIG. 5 is a diagram for describing an example of processing performed by the control unit 200 of Embodiment 1. The RGB segments shown in FIG. 5 correspond to the colors of the segments of the color wheel 150. The setting current value shown in FIG. 5 indicates the current value that is to be applied to the light source in the corresponding segment. The polarity in FIG. 5 indicates the polarity of the current that is to be applied to the light source.

Note that in order to facilitate understanding, the RGB segments shown in FIG. 5 are periods having the same length, but normally they have different lengths corresponding to the segment angle of the color wheel 150 (the same follows for FIGS. 8, 9, and 11 in later descriptions as well).

FIG. 5 shows an example of the case where the polarity inversion cycle is synchronized with the rotation cycle of the color wheel 150, and there is a switch from an image with a high input signal saturation in frame 1 to an image with a low input signal saturation in frame 2. In the case shown here, G has the highest current value among the predetermined ratios for RGB. β indicates the absolute value of the current value for performing a polarity inversion required to increase the lifetime of the light source.

In FIG. 5, the light quantity ratios for the RGBW periods satisfy G>R=B>W in the case where the input signal saturation is high, and satisfy W>G>R=B in the case where the input signal saturation is low.

In the frame 1, according to the light quantities for the RGBW periods calculated by the calculation unit 230, the current values for the RGB periods are relatively increased with respect to the W period, and the current value for the W period is reduced by the same amount as the increase. The light source control unit 240 performs setting such that polarity inversion is performed immediately after the G period in which the absolute value of the current value is greater than or equal to 3 in synchronization with the rotation cycle of the color wheel 150. On the other hand, in the frame 2, according to the light quantities for the RGBW periods obtained by the calculation unit 230, the current values for the RGB periods are relatively decreased with respect to the W period, and the current value for the W period is increased by the same amount as the decrease. For this reason, the light source control unit 240 is set such that the phase of the polarity inversion cycle is shifted so that polarity inversion is performed immediately after the W period in which the absolute value of the current value is greater than or equal to β.

1-4. Effects

In the projector 100 of the present embodiment, the control unit 200 sets the current values of the current to be applied to the light source unit 130 and the polarity inversion timing for inverting the polarity of the light source unit 130 according to the saturation of the input image signal, applies a current to the light source unit 130 while inverting the polarity according to the polarity inversion timing in synchronization with the rotation cycle of the color wheel 150, and shifts the polarity inversion timing according to change in the saturation of the input image signal. Here, the current values that are to be applied for the respective segments of the color wheel 150 are dynamically changed according to the brightness or vividness of the image. This makes it possible to maintain color balance and improve image quality.

Also, the control unit 200 shifts the polarity inversion timing according to dynamic change in the current values caused by change in the saturation of the input image signal, thus making it possible to achieve an increased lifetime for the light source lamp.

1-5. Modified Example 1

Embodiment 1 describes the case where the polarity inversion timing is controlled in synchronization with the rotation cycle of the color wheel 150 as shown in FIG. 5. Modified Example 1 describes an example in which multiple polarity inversion cycles are set.

Originally, light quantity changes occur due to temporary changes in the current value when the polarity of the light source unit 130 is inverted. For this reason, there are cases where the color balance of the image changes, although to a slight degree, when the polarity inversion cycle is switched. Accordingly, in Modified Example 1, the perceptibility of color balance changes is reduced by making a scene change determination and changing one polarity inversion cycle to another polarity inversion cycle based on the determination result.

Figure 8:
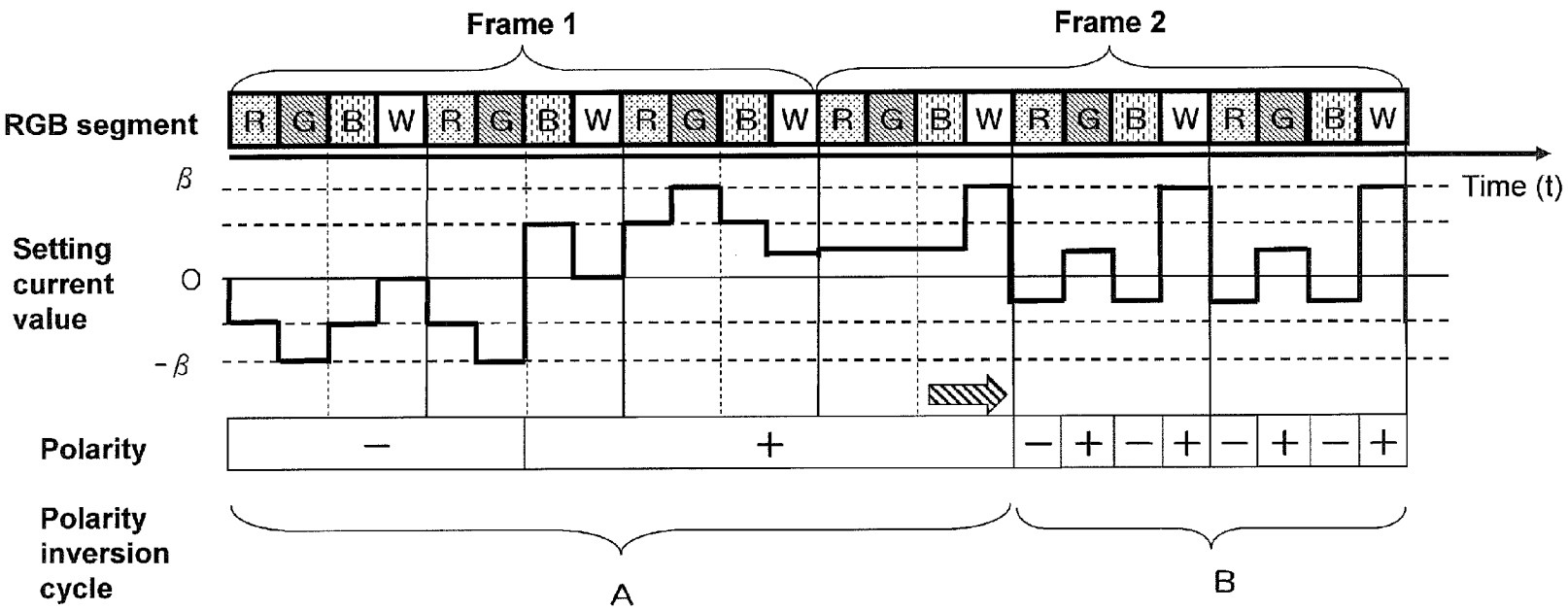
FIG. 8 is a diagram describing a modified example of processing.

The following describes the content of control performed by the control unit 200 of Modified Example 1 with reference to FIG. 8.

FIG. 8 is a diagram for describing Modified Example 1 of Embodiment 1. The RGB segments shown in FIG. 8 correspond to the colors of the segments of the color wheel 150. The setting current value shown in FIG. 8 indicates the current value that is to be applied to the light source unit 130 in the corresponding segment. The polarity inversion trigger shown in FIG. 8 is a pulse signal for inverting the polarity (plus or minus) of the current that is to be applied to the light source. The polarity in FIG. 8 indicates the polarity of the current that is to be applied to the light source. The polarity inversion cycle shown in FIG. 8 indicates the cycle according to which the polarity is inverted.

A cycle A indicates a cycle in which one cycle of the polarity inversion cycle corresponds to four rotations of the color wheel 150. A cycle B indicates a cycle in which polarity inversion is performed in synchronization with the end of each of the RGBW periods.

The light source control unit 240 controls the light source unit 130 such that a first polarity is achieved in a first period, and a second polarity is achieved in a second period, and switches the first period and the second period according to the analysis result of the analysis unit 220. The first period refers to a minus period, for example. The second period refers to a plus period, for example. The first polarity refers to minus, and the second polarity refers to plus.

The analysis unit 220 calculates the difference between the input signal saturation of the previous frame and the input signal saturation of the current frame, and makes a scene change determination. For example, in the case where the input signal saturation difference value is greater than or equal to a threshold value, it is determined that the scene has changed, and the input signal saturation of the current frame is used as is. On the other hand, in the case where the input signal saturation difference value is less than the threshold value, if the input signal saturation of the current frame is less than the input signal saturation of the previous frame, a value obtained by reducing the input signal saturation of the previous frame by a predetermined value is set as the input signal saturation of the current frame. Also, in the case where the input signal saturation difference value is less than the threshold value, if the input signal saturation of the current frame is greater than or equal to the input signal saturation of the previous frame, a value obtained by increasing the input signal saturation of the previous frame by a predetermined value is set as the input signal saturation of the current frame.

FIG. 8 shows an example in which there is a switch from an image with a high input signal saturation in frame 1 to an image with a low input signal saturation in frame 2. The input signal saturation calculated by the calculation unit 230 changes from frame 1 to frame 2. According to the value of the input signal saturation, the light source control unit 240 reduces the light source current values for the RGB periods and increases the light source current value for the W period. Here, the period in which the absolute value of the light source current value required to increase the lifetime of the light source unit 130 is β changes from G to W. For this reason, the polarity inversion cycle is shifted to the W period. Furthermore, according to the analysis result of the analysis unit 220, the light source control unit 240 determines that a scene change occurred based on change in the input signal saturation, and based on this result, the light source control unit 240 switches the polarity inversion cycle from the cycle A to the cycle B at the timing of the W period in which the current value is greater than or equal to the predetermined current value β in the frame 2.

As described above, the color wheel 150 has multiple segments. Among the complimentary color segments of the color wheel 150, and among the simple color segments as well, there is a segment having the smallest segment angle. The polarity inversion timing is switched according to the image for at least two segments among the W segment and the segments having the smallest segment angle.

In the projector 100 of the above-described modified example, even in the case where there are multiple polarity inversion cycles, it is possible to reduce the perceptibility of color balance changes that occur when the polarity inversion cycle is switched. This makes it possible to improve image quality.

Embodiment 2

Embodiment 2 describes a projector that employs a method of suppressing flickering caused by steep power changes, in addition to the control of Embodiment 1.

2-1. Configuration

The projector of the present embodiment has the same configuration as the projector 100 of Embodiment 1 shown in FIGS. 1 to 3, and therefore a description of the configuration will not be given. Also, the same figures and reference signs will be used below when referring to configurations and functions that are the same as in Embodiment 1.

2-2. Operations

The control unit 200 (FIG. 3) of the projector 100 of the present embodiment references the input signal saturations calculated for frames, each of which is made up of multiple sub frames, and based on the correlation with the previous and subsequent frames, changes the light quantities in sub frames so as to reduce the light quantity difference with respect to the previous and subsequent frames. Here, control is performed such that the necessary light quantities in the RGBW periods in the frame do not increase or decrease.

For example, in the case where the result of the analysis of the input signal saturation of the previous and subsequent frames by the analysis unit 220 is that the input signal saturation monotonally decreases, the current values are controlled so as to achieve a relationship of monotonal reduction in the RGB periods and monotonal increase in the W period in the frame. Also, in the case where the input signal saturation monotonally increases, the current values are similarly controlled so as to achieve a relationship of monotonal increase in the RGB periods and monotonal reduction in the W period in the frame.

Figure 9A:
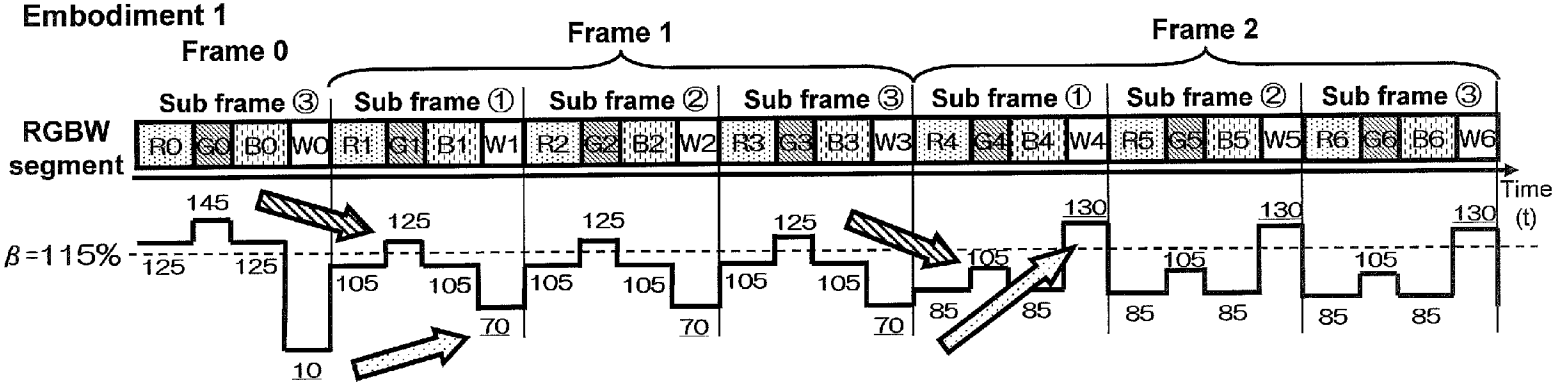
FIGS. 9A and 9B are diagrams describing an example of processing.
Figure 9B:
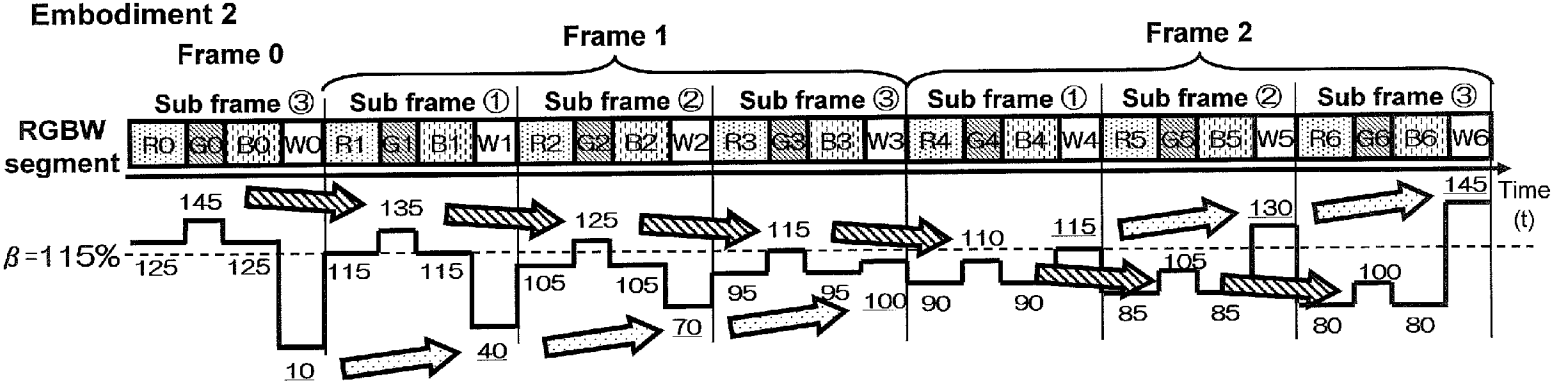

FIGS. 9A and 9B are diagrams for describing an example of processing according to Embodiment 2. In FIGS. 9A and 9B, the input image signal is 60 Hz, and the color wheel is operating at 180 Hz. Also, the input signal saturation monotonally decreases from frame 0 to frame 2.

In Embodiment 1, the same light quantities are set in the sub frames 1 to 3, and therefore the light quantities change to a large degree at the frame switch timing as shown in FIG. 9A.

However, in the example according to the present embodiment shown in FIG. 9B, a steep change in luminance between frames can be suppressed by the processing procedure described below.

In FIG. 9B, first, the light quantities in the RGBW periods of the previous and subsequent frames are compared with the current frame. A determination of monotonal increase or monotonal decrease is then made based on the result of the comparison. Secondly, in the case of monotonal increase, the light quantities in the sub frame 1 of the current frame are reduced and the light quantities in the sub frame 3 of the current frame are increased according to, out of the light quantity difference between the current frame and the sub frame 3 of the previous frame and the light quantity difference between the current frame and the subsequent frame, the one with the lower amount of light quantity change, which is the absolute value of the light quantity difference. Here, adjustment is performed such that the absolute value of the current value is greater than or equal to β in at least one period among the RGBW periods.

Note that if the absolute value of the current value is less than β in all of the periods due to an increase or decrease in the light quantity, the amount of change is reduced such that the absolute value of the current value is greater than or equal to β in at least one of the periods. The absolute value of the current value β here is obtained by converting a current value for performing a polarity inversion required to increase the lifetime of the light source into a light quantity. Alternatively, a configuration is possible in which polarity inversion is not performed at the set polarity inversion timing if the absolute value of the current value is not less than β in all of the periods due to an increase or decrease in the light quantity.

In FIG. 9B, assuming that the current frame is the frame 1, in the case of the difference with the sub frame 3 of the previous frame, the light quantity difference in the RGB periods was −20% each, and the light quantity difference in the W period was 60%, whereas in the case of the difference with the subsequent frame, the light quantity difference in the RGB periods was 20% each, and the light quantity difference in the W period was −60%. The amount of light quantity change was 20% for the RGB periods and 60% for the W period. Accordingly, the values of the light quantities for the RGB periods of the sub frame 1 of the frame 1 are set 10% higher than the light quantities in the frame 1 (the light quantities in the sub frame 2), and the value of the light quantity for the W period is set 30% lower. The values of the light quantities for the RGB periods in the sub frame 3 are set 10% lower than the light quantities in the frame 1, and the value of the light quantity for the W period is set 30% higher.

2-3. Effects

In the projector 100 of Embodiment 2, the control unit 200 determines whether there is an increase or decrease in the saturation component of the input image signal between the current frame and the previous and subsequent frames, and changes the light quantity ratios in the RGBW periods so as to gradually increase or decrease between the current frame and the previous and subsequent frames. Accordingly, in the case where the lamp current value dynamically changes according to the brightness or vividness of the image as well, it is not only possible to perform polarity inversion control for achieving an increased lifetime for the light source, but also it is possible to additionally suppress flickering caused by steep light quantity changes.

Embodiment 3

The projector of Embodiment 3 performs control such that the integrated current quantity is not biased between the plus and minus polarities in addition to the control of Embodiment 1. In Embodiment 1, the polarity inversion timing is shifted according to the saturation of the input image signal. This causes the applied current quantity to be different between the plus and minus polarities. If the applied current quantity is biased in either the plus or the minus polarity, the electrode tips of the lamp light source will be damaged, and the spot position of exiting light from the lamp light source on the color wheel will become misaligned. As a result, the stability of the lamp light source will be impaired, and this also causes a reduction in the display image quality. In order to prevent this, the integrated current quantity is equalized between the plus and minus polarities in the projector of the present embodiment.

3-1. Configuration

The projector of the present embodiment has the same configuration as the projector 100 of Embodiment 1 shown in FIGS. 1 to 3, and therefore a description of the configuration will not be given. Also, the same figures and reference signs will be used below when referring to configurations and functions that are the same as in Embodiment 1.

Figure 10:
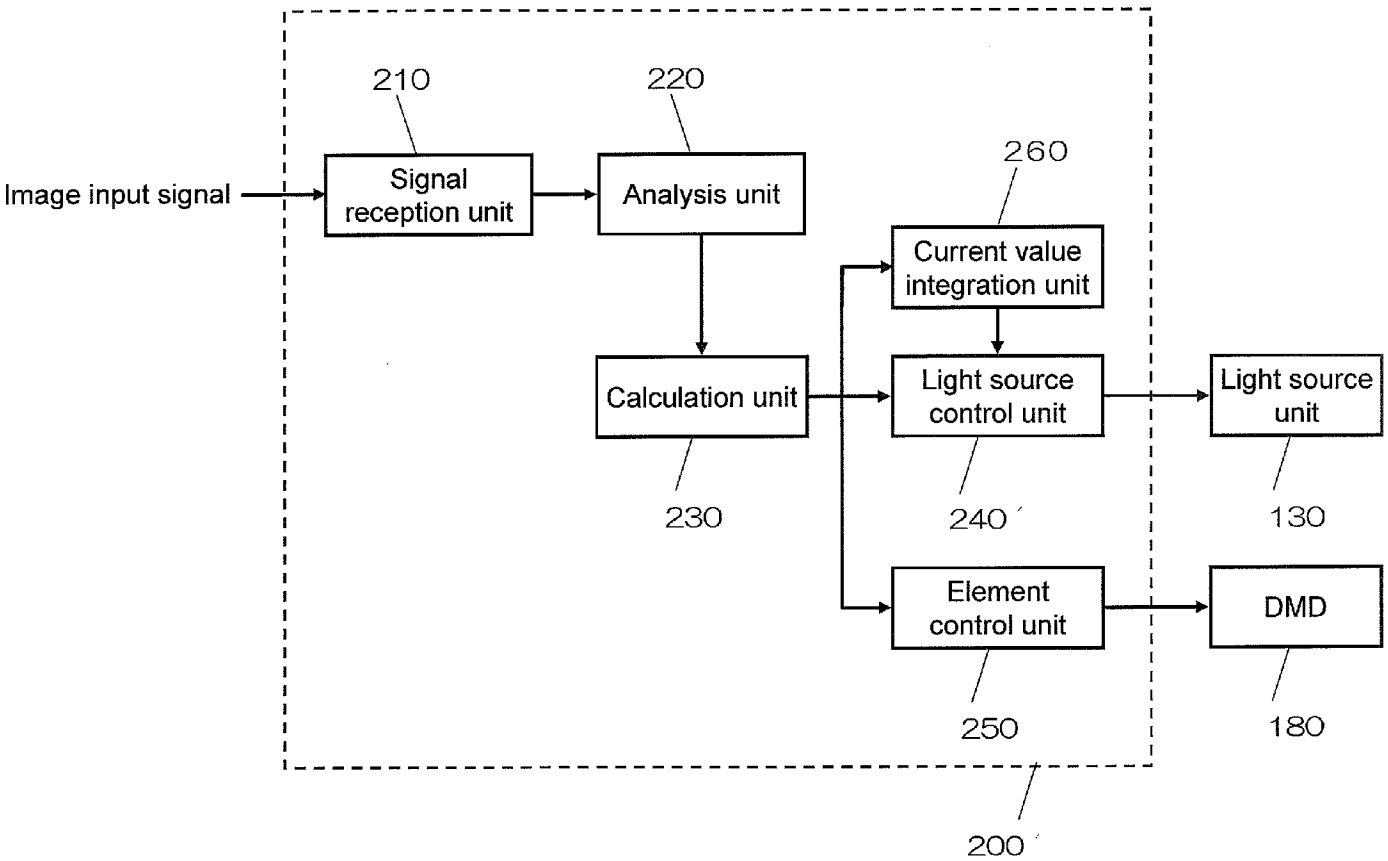
FIG. 10 is a block diagram showing functions of a control unit.

FIG. 10 is a block diagram showing the functions of a control unit 200' of Embodiment 3. As shown in FIG. 3, the control unit 200' differs from Embodiment 1 with respect to including a current value integration unit 260.

The current value integration unit 260 calculates an integrated current value for the plus side and for the minus side based on the current values for the RGBW periods obtained by the calculation unit 230 and polarity inversion position information, and stores the calculated integrated current values in a memory or the like. A light source control unit 240' performs determination processing on the integrated current values obtained from the current value integration unit 260, and shifts the polarity inversion timing according to the determination result.

3-2. Operations

Similarly to Embodiment 1, the input image signal received by the signal reception unit 210 is input to the analysis unit 220. The saturation component of the input image signal is analyzed in the analysis unit 220, and a value indicating the saturation of the input image signal is input to the calculation unit 230.

In the calculation unit 230, current values are calculated according to the light quantity ratios for the RGBW periods based on the saturation of the input image signal obtained by the analysis unit 220. Also, the calculated current values are set such that the current value is greater than or equal to the predetermined current value in any of the RGBW periods.

In the current value integration unit 260, an integrated current value is calculated for the plus side and for the minus side based on the current values for the RGBW periods obtained by the calculation unit 230 and polarity inversion position information, and the calculated integrated current values are stored in a memory or the like.

The light source control unit 240' applies the current values that correspond to the light quantity ratios for the RGBW periods that were calculated by the calculation unit 230 to the light source unit 130.

Also, in the light source control unit 240', the period in which the current value is greater than or equal to the predetermined current value among the RGBW periods is set as the polarity inversion timing, a determination is made on the integrated current values acquired by the current value integration unit 260, and the polarity inversion timing is shifted according to the determination result. For example, in the case where a bias of the integrated current value on the plus side or the minus side is greater than or equal to the integrated current value of one sub frame (one group of RGBW), the polarity inversion timing is shifted by one sub frame. For example, the integrated current value on the plus side is higher if the following condition is satisfied:

(integrated current value on plus side)−(integrated current value on minus side)≥(current value for 1 sub frame)

Accordingly, the light source control unit 240' eliminates the bias of the integrated current value toward the plus side by extending the minus polarity period by one sub frame.

Figure 11:
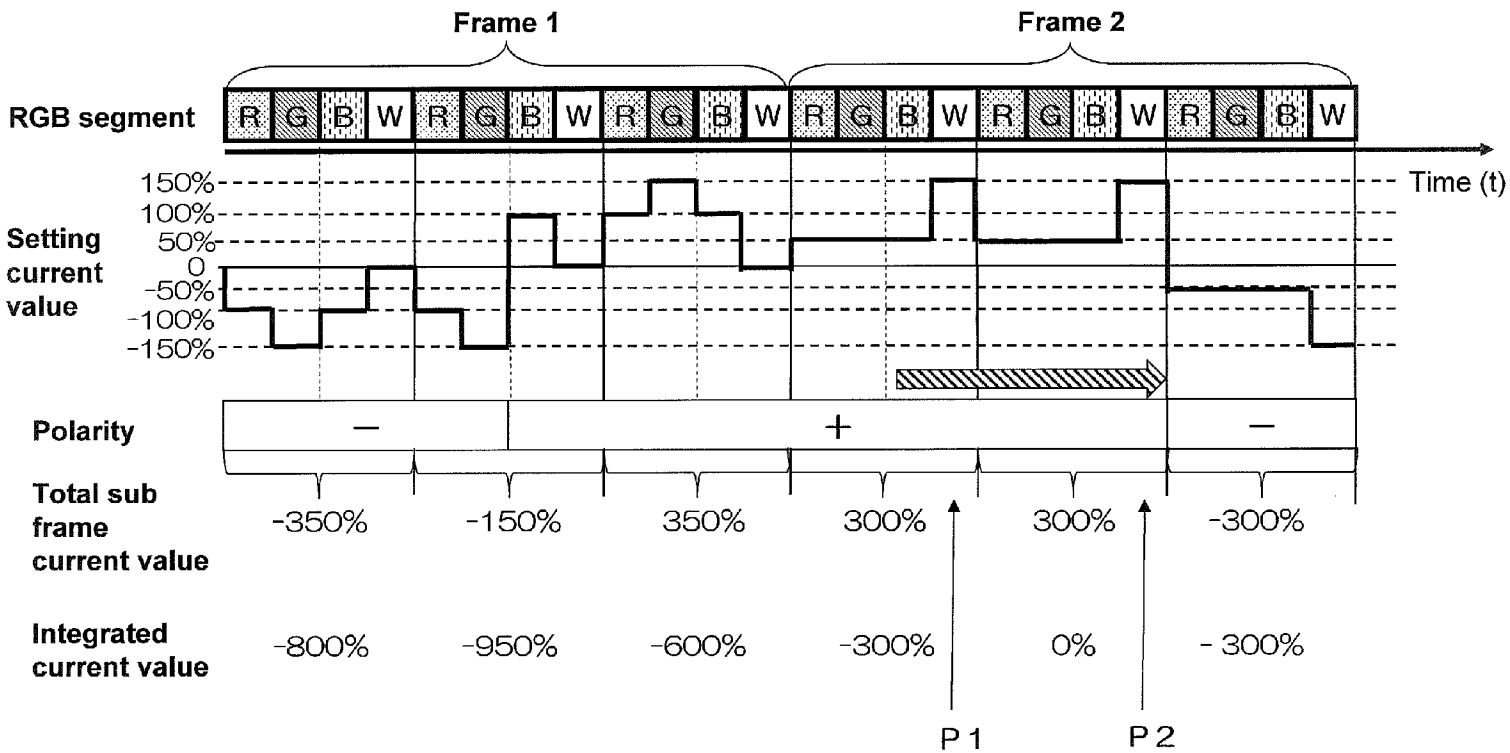
FIG. 11 is a diagram describing an example of processing.

FIG. 11 is a diagram for describing an example of processing performed by the control unit 200' of Embodiment 3. The RGB segments shown in FIG. 11 correspond to the colors of the segments of the color wheel 150. The setting current value shown in FIG. 11 indicates the current value that is to be applied to the light source in the corresponding segment. The polarity in FIG. 11 indicates the polarity of the current that is to be applied to the light source. The total sub frame current value shown in FIG. 11 indicates the total current value in each sub frame. The integrated current value shown in FIG. 11 indicates the integrated current value in the projector 100. Note that in the example in FIG. 11, the integrated current value is −450% at the start of the frame 1.

As shown in FIG. 11, in the frame 2, according to Embodiment 1, setting is performed such that the current value is greater than or equal to the predetermined current value in the W period, and a position P1 in that period is set as the polarity inversion (from plus to minus) timing. However, at P1, (integrated current value on plus side)−(integrated current value on minus side)=−300%. This is greater than or equal to the current value for one sub frame (300%). Accordingly, the light source control unit 240' does not perform polarity inversion from plus to minus at P1, but rather performs polarity inversion from plus to minus at the next polarity inversion position P2.

Note that although the polarity period is extended in units of one sub frame in the above example, the present invention is not limited to this. For example, the polarity period may be extended by a period shorter than one sub frame. Also, the timing of the polarity inversion position change does not need to be a sub frame timing.

3-3. Effects Etc

In the projector 100 of Embodiment 3, the control unit 200' calculates the integrated value of the applied current for the plus polarity and for the minus polarity of the light source unit 130, and shifts the polarity inversion timing such that the integrated value of the current for the plus polarity and the integrated value of the current for the minus polarity are substantially the same. This makes it possible to prevent the lamp light source from being damaged due to a bias in the integrated current quantity between the plus and minus polarities, ensure stability of the lamp light source, and prevent a reduction in display image quality.

Other Embodiments

Examples of implementation of the present invention have been described in Embodiments 1 to 3 above. However, the present invention is not limited to these embodiments, and is also applicable to embodiments obtained through modifications, replacements, additions, omissions, or the like as necessary.

(1) In the projector 100 of the above embodiments, the analysis unit 220 of the control unit 200 acquires the highest value for the saturation component of the input image signal as the input signal saturation based on the input image signal for each of the pixels constituting the frame. However, the present invention is not limited to this, and a configuration is possible in which the analysis unit 220 acquires the average value for the saturation component of the input image signal as the input signal saturation based on the input image signal for each of the pixels constituting the frame.

The analysis unit 220 may also analyze luminance information or hue information in addition to the saturation information, and add the analyzed information to the input signal saturation. Specifically, the input signal saturation may be acquired by multiplying the saturation and the luminance for each pixel.

Furthermore, the analysis unit 220 may generate a histogram showing the pixel frequency (number of pixels) for each saturation component of the input image signal. In this case, a configuration is possible in which the analysis unit 220 acquires the variance value for the saturation component of the input image signal as the input signal saturation based on the input image signal for each of the pixels constituting the frame.

(2) In the above embodiments, a conversion function (FIG. 4) is used when obtaining the current values to be set for the light source based on the light source light quantity ratios. However, the conversion function is not limited to this, and it may be implemented as an LUT (Look Up Table).

(3) The example of an RGBW four-color color wheel is given in the above embodiments. However, the embodiments are not limited to this. For example, an RGBCMYW color wheel may be used. Also, it is described that the second segment is the white segment in Embodiment 1. However, there is no limitation to this, and the second segment may include multiple segments, namely the cyan, magenta, and yellow segments. In other words, the second segment need only be able to generate white light.

(4) It is described that the rotation frequency of the color wheel is 180 Hz in the above embodiments. However, there is no limitation to this, and a configuration is possible in which the color wheel is driven at 120 Hz or 240 Hz, and the number of sub frames is increased or reduced, for example.

(5) Although the example where the absolute value of the current value is set greater than or equal to β in the G or W period among the RGBW periods in the above embodiments, the absolute value of the current value may be set greater than or equal to β in another period. For example, in the case of an RGBCMYW color wheel, the absolute value of the current value may be set to a current value greater than or equal to β in one period among the RGB periods, one period among the CMY periods, or in the W period. Also, giving consideration to white balance, it is desirable that the current value is set the highest (the absolute value of the current value is set to a current value greater than or equal to β) in, among the RGB periods, the period for the color that has the smallest segment angle in the color wheel. The same follows for the CMY periods as well.

(6) Note that the blocks of the control unit 200 or 200' of the projector 100 described in the above embodiments may be implemented as single individual chips by employing semiconductor devices such as LSIs, or some or all of the blocks may be implemented as a single chip.

Also, the processing performed by the control unit 200 or 200' of the above embodiments may be realized by hardware, or may be realized by software. Furthermore, such processing may be realized by a combination of software and hardware.

(7) The present invention is not limited to being realized as the projection-type image display device of the above embodiments, and may also be realized as a control device, image projection control method, or image projection control program for controlling a projection-type image display device.

The present invention is applicable to, for example, a projection-type image display device such as a projector.

What is claimed is:

1. A projection-type image display device that receives an image signal and displays an image based on the input image signal by projection, comprising:

a light source unit configured to emit light based on an applied current;

a color generation unit that is provided on an optical path of emitted light from the light source unit, the color generation unit being configured to generate a plurality of colors of light from the emitted light in a time-division manner by rotating at a predetermined rotation cycle;

a light modulation unit configured to modulate the plurality of colors of light generated by the color generation unit, based on the input image signal; and a control unit configured to control the light source unit and the light modulation unit, wherein in accordance with a color component of the input image signal, the control unit sets current values for current to be applied to the light source unit and a polarity inversion timing for inverting a polarity of the light source unit, in synchronization with the predetermined rotation cycle of the color generation unit, the control unit applies current having the current values to the light source unit while inverting the polarity of the light source unit according to the polarity inversion timing, and the control unit shifts the polarity inversion timing according to change in the current values for current to be applied to the light source unit.

2. The projection-type image display device according to claim 1, wherein for each frame serving as a unit configuring an image, the control unit determines light quantity ratios for the plurality of colors of light according to the color component of the input image signal, the control unit sets the current values such that the colors of light are output according to the corresponding light quantity ratios, and the control unit sets the polarity inversion timing in accordance with a timing of application of current having a highest current value among the current values for outputting the plurality of colors of light.

3. The projection-type image display device according to claim 2, wherein the control unit determines the light quantity ratios such that the highest current value is greater than or equal to a predetermined current value that is higher than an average value of the current values for outputting the plurality of colors of light.

4. The projection-type image display device according to claim 2, wherein the control unit sets the highest current value for a different color of light by changing the light quantity ratios for the plurality of colors of light according to the change in the color component of the input image signal.

5. The projection-type image display device according to claim 2, wherein the plurality of colors of light include at least red (R), green (G), blue (B), and white (W), in a case where any of light quantities for the red (R), green (G), and blue (B) light is greater than a light quantity for the white (W) light, the control unit determines the light quantity ratios such that the current value for outputting at least one color of light among the red (R), green (G), and blue (B) light is greater than or equal to the highest current value, and in a case where the light quantity for the white (W) light is greater than the light quantities for the red (R), green (G), and blue (B) light, the control unit determines the light quantity ratios such that the current value for outputting the white (W) light is the highest current value.

6. The projection-type image display device according to claim 1, wherein the control unit controls the light source unit such that a first polarity that is one of plus and minus is achieved in a first period, and such that a second polarity that is a different polarity from the first polarity is achieved in a second period, and the control unit controls the first period and the second period according to the change in the color component of the input image signal.

7. The projection-type image display device according to claim 1, wherein the control unit sets at least two polarity inversion cycles having different cycles, and the control unit switches the at least two polarity inversion cycles according to the polarity inversion timing that is shifted according to the change in the color component of the input image signal.

8. The projection-type image display device according to claim 2, wherein the control unit determines whether the color component of the input image signal has increased or decreased between one frame and a frame previous or subsequent to the one frame, and the control unit changes the light quantity ratios for the plurality of colors of light such that the increase or decrease is gradual between the one frame and the previous or subsequent frame.

9. The projection-type image display device according to claim 1, wherein the control unit sets the polarity inversion timing in accordance with a timing of application of current having a highest current value among the current values for outputting the plurality of colors of light, and in a case where the highest current value is not greater than or equal to a predetermined current value, the control unit does not invert the polarity of the light source unit at the set polarity inversion timing.

10. The projection-type image display device according to claim 1, wherein the color generation unit has a color wheel that undergoes at least two or more complete rotations when displaying one frame serving as a unit configuring an image of the input image signal, the one frame is configured by a plurality of sub frames, and each sub frame corresponds to one complete rotation of the color wheel, and the control unit sets a different current value for each sub frame based on the color component of the input image signal.

11. The projection-type image display device according to claim 1, wherein the color generation unit has a color wheel that has a plurality of segments that respectively correspond to the plurality of colors, the plurality of segments include complimentary color segments and simple color segments, a segment having a smallest segment angle is included among the complimentary color segments and among the simple color segments, and the polarity inversion timing is set in synchronization with at least two segments among a white segment and the segments having the smallest segment angle.

12. The projection-type image display device according to claim 1, wherein the control unit calculates an integrated value of the applied current for each of two polarities of the light source unit, the two polarities including a plus-side polarity and a minus-side polarity, and the control unit changes the polarity inversion timing such that the integrated value of the current for the plus-side polarity and the integrated value of the current for the minus-side polarity are substantially the same.

13. The projection-type image display device according to claim 1, wherein the color component is at least one of a saturation, a luminance, and a hue.

14. An image projection control device for controlling a projection-type image display device that is provided with a light source unit and a color wheel and that receives an image signal and displays an image based on the input image signal by projection, the image projection control device comprising:

a calculation unit configured to, in accordance with a color component of the input image signal, set current values for current to be applied to the light source unit and a polarity inversion timing for inverting a polarity of the light source unit; and a light source control unit configured to, in synchronization with a predetermined rotation cycle of the color wheel, apply current having the current values to the light source unit while inverting the polarity of the light source unit according to the polarity inversion timing, the light source control unit being further configured to shift the polarity inversion timing according to change in the current values for current to be applied to the light source unit.

15. An image projection control method of controlling a projection-type image display device that is provided with a light source unit and a color wheel and that receives an image signal and displays an image based on the input image signal by projection, the image projection control method comprising:

setting current values for current to be applied to the light source unit and a polarity inversion timing for inverting a polarity of the light source unit, in accordance with a color component of the input image signal;

applying current having the current values to the light source unit while inverting the polarity of the light source unit according to the polarity inversion timing, in synchronization with a predetermined rotation cycle of the color wheel; and shifting the polarity inversion timing according to change in the current values for current to be applied to the light source unit.

* * * * *